US007607937B1

(12) United States Patent
Chang

(10) Patent No.: US 7,607,937 B1
(45) Date of Patent: Oct. 27, 2009

(54) POWER PLUG ASSEMBLY

(75) Inventor: Hsing-Wang Chang, Shenkeng Township, Taipei County (TW)

(73) Assignee: Taiwan Line Tek Electronic Co., Ltd., Taipei County (TW)

( * ) Notice: Subject to any disclaimer, the term of this patent is extended or adjusted under 35 U.S.C. 154(b) by 0 days.

(21) Appl. No.: 12/137,772

(22) Filed: Jun. 12, 2008

(30) Foreign Application Priority Data

May 6, 2008 (CN) ..... 2008 2 0104977 U

(51) Int. Cl.
*H01R 3/00* (2006.01)

(52) U.S. Cl. ..... 439/490; 362/95; 362/114; 362/190

(58) Field of Classification Search ..... 439/490; 362/95, 114, 190
See application file for complete search history.

(56) References Cited

U.S. PATENT DOCUMENTS 6,572,402 B2 * 6/2003 Lin ..... 439/490
7,086,892 B2 * 8/2006 Tanacan et al. ..... 439/490
2004/0235338 A1 * 11/2004 Lee ..... 439/490
2006/0039136 A1 * 2/2006 Probasco et al. ..... 362/157
2006/0286854 A1 * 12/2006 Kuo ..... 439/490
2008/0293290 A1 * 11/2008 Ku et al. ..... 439/490

* cited by examiner

*Primary Examiner*—Gary F. Paumen
(74) *Attorney, Agent, or Firm*—Guice Patents PLLC

(57) ABSTRACT

The present invention relates to a power plug assembly, includes: a cable having two power wires; a lighting unit, the center of the lighting unit is provided with a ring-shaped hole for being connected onto the cable, and the lighting unit is disposed behind the two power wires, the lighting unit is composed by a ring-shaped housing and a ring-shaped printed circuit board provided in front of the ring-shaped housing, a plurality of light sources connected in parallel via wires are provided in the housing, and the front end of the housing is provided with two power input terminals for being coupled with the printed circuit board, two guiding wires are extendedly provided on the front end of the printed circuit board; a conductive tube having an outer tube and an inner tube, an insulating material is provided between the outer tube and the inner tube, with respect to the polarity, the two power wires and the two guiding wires are respectively provided on the outer tube and the inner tube, then a welding operation is processed so as to fasten the two power wires and the two guiding wires on the conductive tube; and an outer covering member made by an operation of plastic injection and served to cover the rear portion of the conductive tube, the front portion of the cable and the lighting unit, and the ring-shaped housing is exposed out of the outer covering member.

16 Claims, 7 Drawing Sheets

POWER PLUG ASSEMBLY

BACKGROUND OF THE INVENTION

1. Field of the Invention

The present invention relates to a power plug assembly, more particularly to a power plug assembly having a function of lighting indication.

2. Description of Related Art

Power plugs are commonly seen and used in daily life and can be categorized to two sorts, a power receiving plug and a power supplying plug, wherein the power receiving plug is often an AC power plug having two or three electrodes for obtaining the public power source; the power supplying plug mostly is a round-column shaped DC power supply, and the outer diameter of the power supplying plug is varied with respect to a diameter of a power socket of an electronic device, e.g. a notebook computer.

As shown in FIG. 1, which is a schematic view of a connection between a cable 10 and a conductive tube 20 of a conventional power supplying plug, the cable 10 includes two power wires 101, 102, respectively having positive electricity and negative electricity; for proving a signal transferring function to the cable 10, the cable 10 can be further provided with a signal wire 103. In order to have the end sections of the wires of the cable 10 connected to the conductive tube 20, the wires respectively having positive electricity and negative electricity are correspondingly welded to the corresponding sections on the conductive tube 20, so an outer tube 201 and an inner tube 202 of the conductive tube 20 are respectively provided with functions of transferring negative electricity and positive electricity, then an operation of embedded-type plastic injection is operated so as to obtain a covering member for covering and packaging the connecting section between the cable 10 and the conductive tube 20, thus a power supplying plug is obtained.

A means commonly used for observing whether a power supplying plug is normally operated is to observe the power supplying status of an electronic goods to which the power supplying plug is inserted, e.g. a charging status shown on a screen of a mobile phone, or a charge indicating lamp of a notebook computer, for observing the operation of the power supplying plug is not convenient. The Taiwan Patent Application No. 097202976, corresponding to the China Patent Application No. 200820007120.4, titled "Power plug assembly", has disclosed that a printed circuit board is crossly connected to a positive terminal and a negative terminal of a terminal set, the rear end of each of the terminals is provided with a connecting section respectively connected to end sections of power wires of a cable, and the front end of each of the terminals is respectively welded to an outer tube and an inner tube of a conductive tube. A LED is provided on the printed circuit board and the LED can be lit by obtaining the required power via the printed circuit board, and lights illuminated from the LED pass through a transparent inner covering member and a pre-set window provided on an opaque outer covering member, so a user can be informed that the power plug is in a power-supplying status.

The art disclosed by the above mentioned patent application has solved the problems that conventional power plugs are not provided with a function of indicating the current status of the power plug, but only a single light source is adopted for indicating, so an improvement of increasing the illuminating area or increasing illumination for a better identification is needed.

SUMMARY OF THE INVENTION

The applicant of the present invention has devoted himself to design and commercially distribute power plugs, power sockets and cables, with a hope that by increasing illuminating area exposed out of a power plug, the illumination can be increased, after try and error, the present invention, "Power plug assembly" is provided.

One object of the present invention is to provide a power plug assembly having an indicating function such as an indication of power conduction.

Another object of the present invention is to provide a power plug assembly in which illuminating area exposed out of the power plug assembly is increased and the appearance of the power plug assembly is improved for providing a clearer identification.

For achieving the objects mentioned above, one art provided by the present invention is to provide a power plug assembly, includes: a cable having two power wires; a lighting unit, the center of the lighting unit is provided with a ring-shaped hole for being connected onto the cable, and the lighting unit is disposed behind the two power wires, the lighting unit is composed by a ring-shaped housing and a ring-shaped printed circuit board provided in front of the ring-shaped housing, a plurality of light sources connected in parallel via wires are provided in the housing, and the front end of the housing is provided with two power input terminals for being coupled with the printed circuit board, two guiding wires are extendedly provided on the front end of the printed circuit board; a conductive tube having an outer tube and an inner tube, an insulating material is provided between the outer tube and the inner tube, with respect to the polarity, the two power wires and the two guiding wires are respectively provided on the outer tube and the inner tube, then a welding operation is processed so as to fasten the two power wires and the two guiding wires on the conductive tube; and an outer covering member made by an operation of plastic injection and served to cover the rear portion of the conductive tube, the front portion of the cable and the lighting unit, and the ring-shaped housing is exposed out of the outer covering member.

Another art provided by the present invention is to provide a power plug assembly, includes: a cable having two power wires; a lighting unit, the center of the lighting unit is provided with a ring-shaped hole for being connected onto the cable, and the lighting unit is disposed behind the two power wires, the lighting unit is composed by a ring-shaped housing and a ring-shaped printed circuit board provided in front of the ring-shaped housing, a plurality of light sources connected in parallel via wires are provided in the housing, and the front end of the housing is provided with two power input terminals for being coupled with the printed circuit board, two guiding wires are extendedly provided on the front end of the printed circuit board; a conductive tube having an outer tube and an inner tube; an insulating material is provided between the outer tube and the inner tube, according to the polarity, the two power wires and the two guiding wires are respectively provided on the outer tube and the inner tube, then a welding operation is processed so as to fasten the two power wires and the two guiding wires on the conductive tube; an inner covering member made by an operation of plastic injection and served to cover the rear portion of the conductive tube, the front portion of the cable and the lighting unit, and the ring-shaped housing is exposed out of the inner covering member; and an outer covering member made by an operation of plastic injection and served to cover the inner covering member and the ring-shaped housing is exposed out of the outer covering member

DETAILED DESCRIPTION OF THE PREFERRED EMBODIMENT

Figure 1:
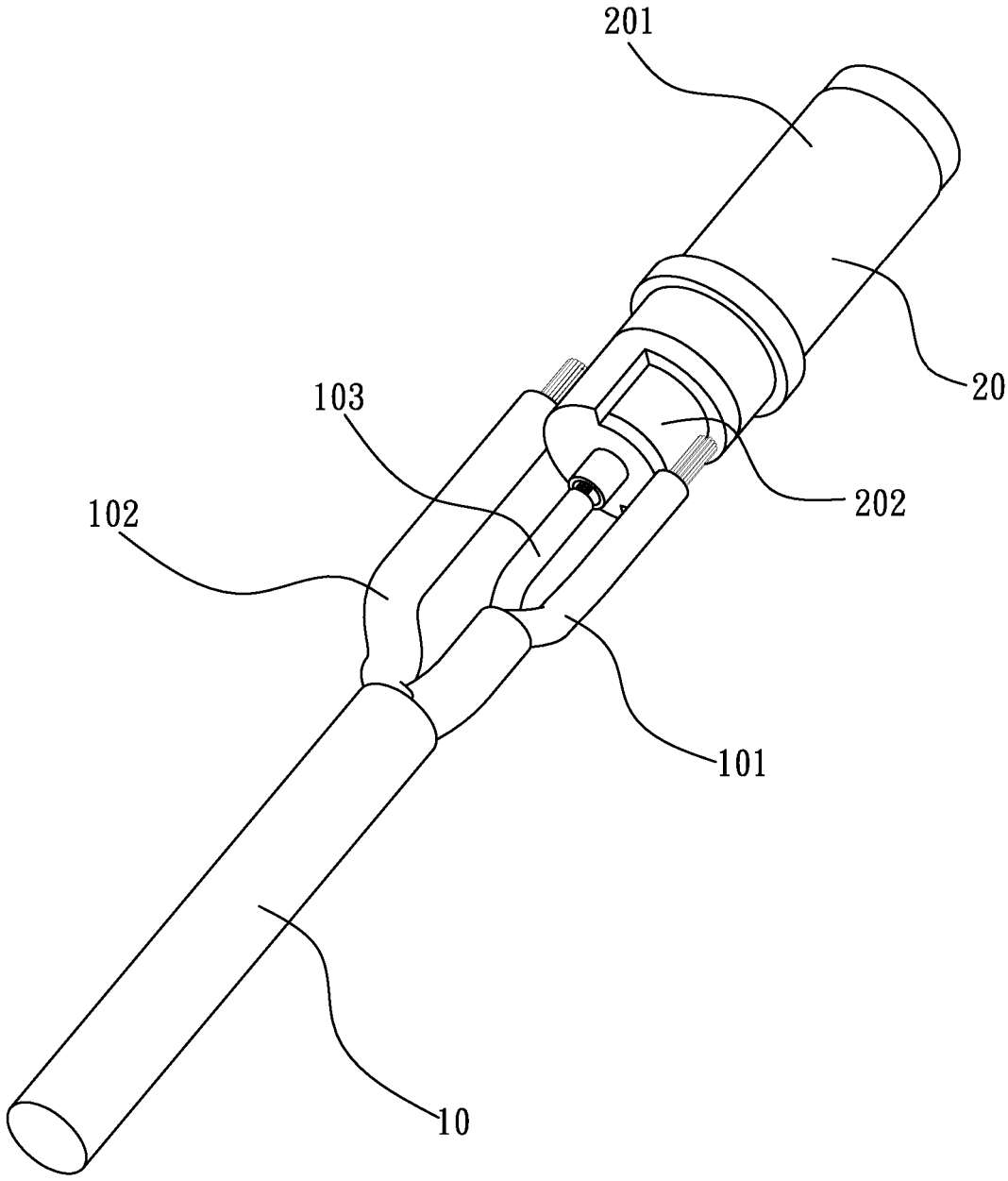
(PRIOR ART) FIG. 1
FIG. 1 is a schematic view of a connection between a cable and a conductive tube of a conventional power plug assembly.
Figure 2:
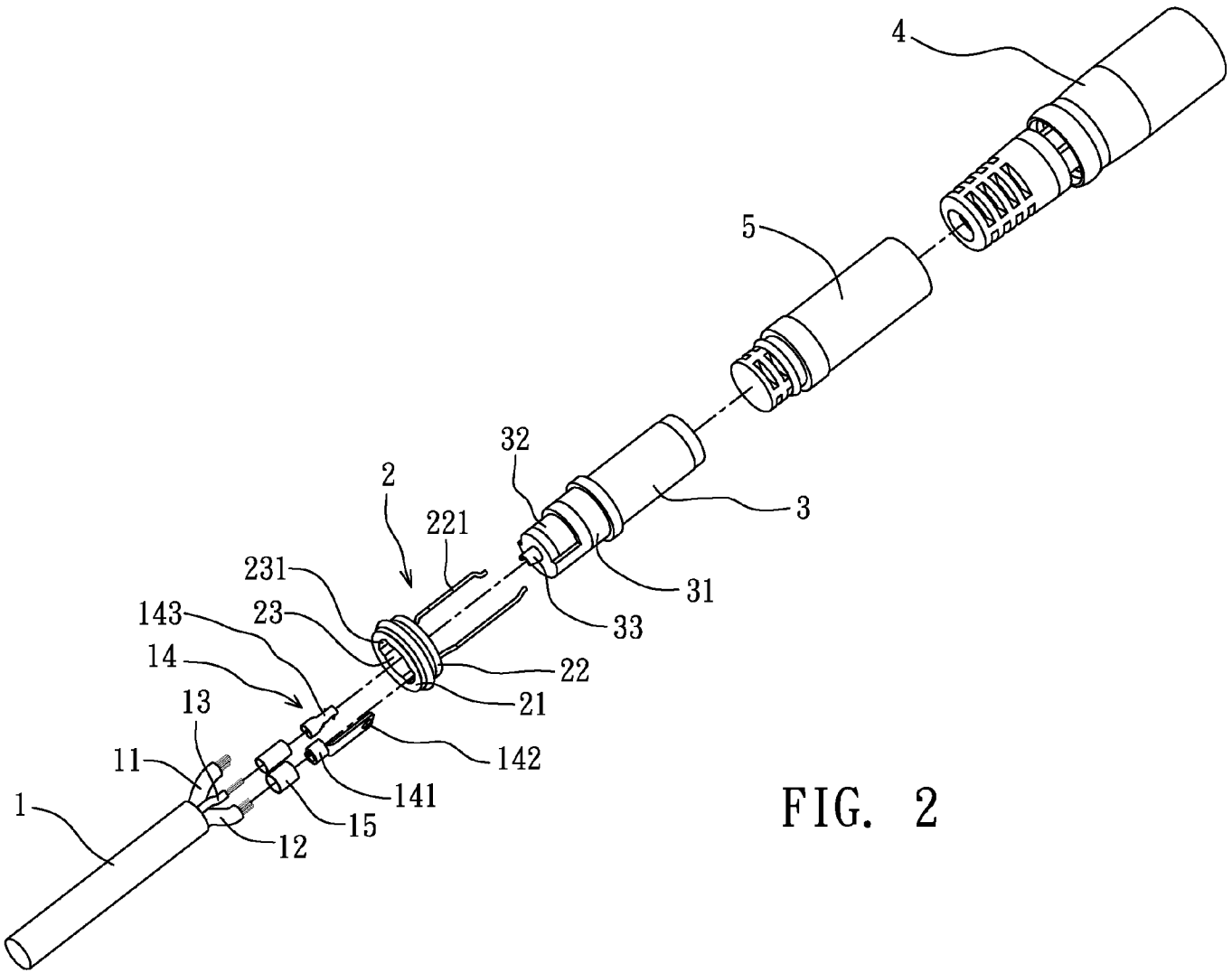
FIG. 2 is a 3D exploded view of the power plug assembly provided by the present invention.
Figure 3:
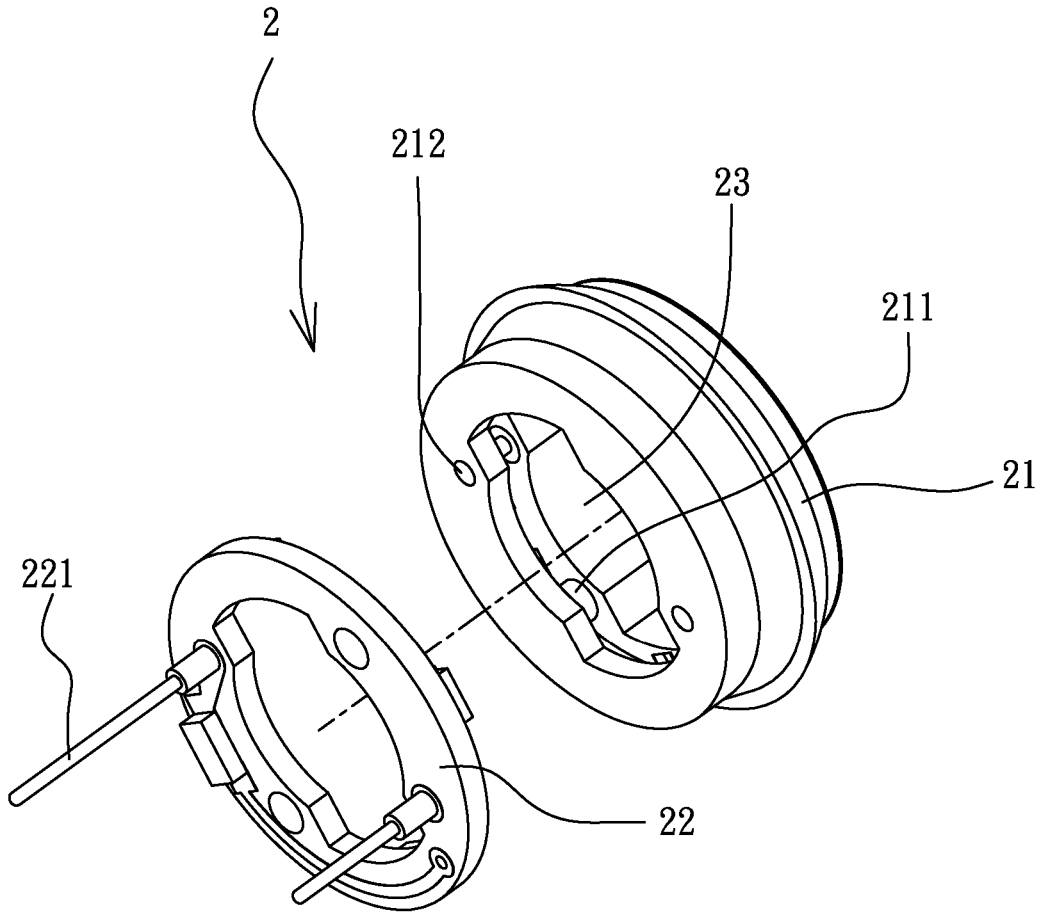
FIG. 3 is a 3D exploded view of the lighting unit provided by the present invention.
Figure 5:
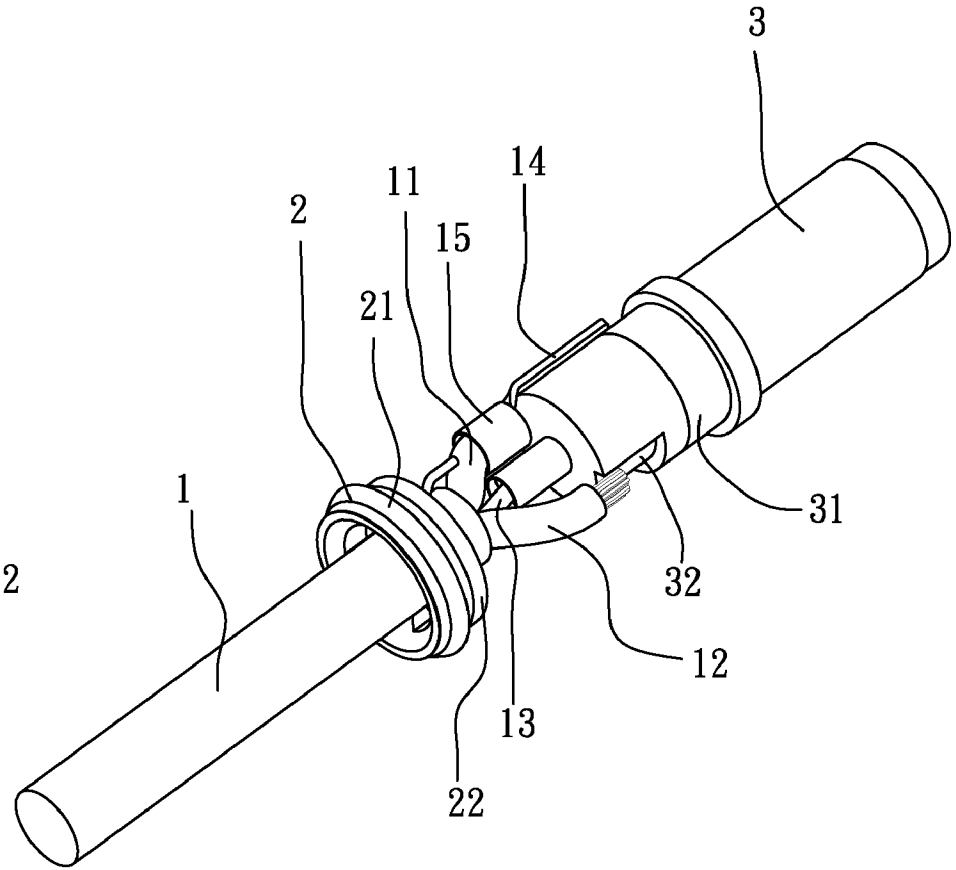
FIG. 5 is a 3D manufacturing flowchart for illustrating the manufacture of the power plug assembly provided by the present invention.

As shown from FIG. 2 to FIG. 9, the power plug assembly provided by the present invention is composed by a cable 1, a lighting unit 2, a conductive tube 3 and an outer covering member 4.

The cable 1 includes two power wires 11, 12 and a signal wire 13 can be provided according to the actual needs, the end sections of the power wires 11, 12 and the signal wire 13 have plural exposed metal conducting wires, such as copper wires, so the cable 1 has positive electricity and negative electricity and has a function of transferring signals.

Figure 4:
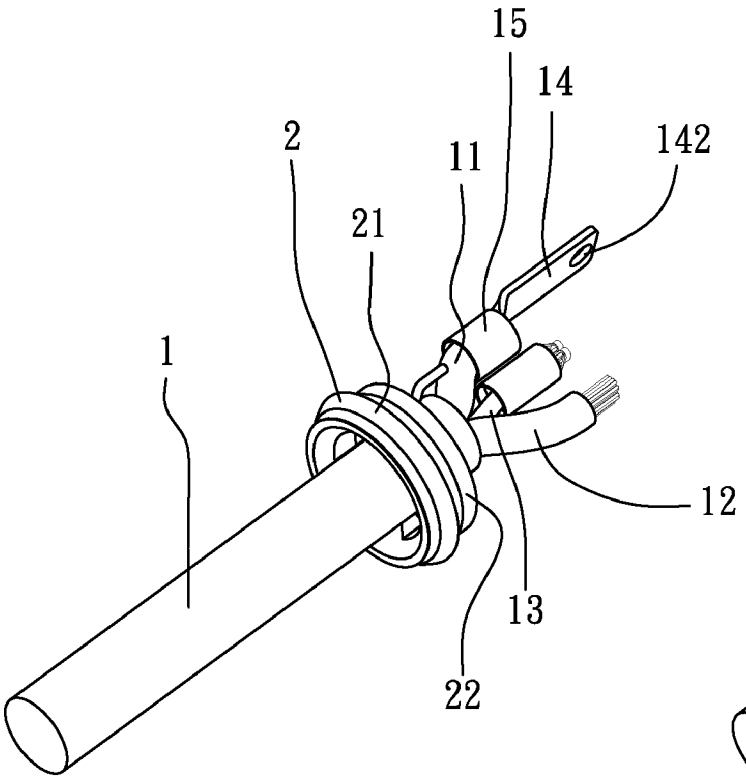
FIG. 4 is a 3D manufacturing flowchart for illustrating the manufacture of the power plug assembly provided by the present invention.

As shown in FIG. 2, FIG. 4 to FIG. 6, for having the power wires 11, 12 or/and the signal wire 13 tightly connected on the conductive tube 3, each of the wires can be optionally provided with a terminal 14 made by punching and bending a metal sheet, e.g. a copper sheet; as shown in figures, the power wire 12 and the signal wire 13 are respectively provided with the terminal 14; wherein the rear end of each of the terminals 14 has a connecting section 141 made by punching and bending two sheet members that are oppositely provided, the connecting sections 141 are served to be respectively clamped and retained on the corresponding end sections of the power wire 12 and the signal wire 13; so after being assembled, the assembly is as shown in FIG. 4. For welding the negative terminal 14 and the conductive tube 3, a plurality of welding holes 142 are provided on the surface of the negative terminal 14, so after the terminal 14 is provided on the corresponding position of the conductive tube 3, the welding material can pass through the welding holes 142, the terminal 14 is therefore fastened on the conductive tube 3 and a tight connection is obtained and the sizes of the welding points are reduced.

In order to prevent each of the terminals 14 of the power wires 11, 12 and the signal wire 13 from generating short circuits, each of the connecting sections 141 of the terminals 14 is provided with a thermal contracting tube 15, for example the connecting sections 141 of the power wire 12 and the signal wire 13 are respectively provided with the thermal contracting tube 15, after being heated, each of the thermal contracting tubes 15 is contracted and covered on the corresponding connecting section 141 of the terminal 14, and an insulating function is therefore provided.

Referring to FIG. 3 to FIG. 6, the lighting unit 2 is provided on the cable 1 and is provided behind the wires, 11, 12, 13, the lighting unit 2 is composed by a ring-shaped housing 21 and a printed circuit board 22 provided in front of the ring-shaped housing 21, a plurality of light sources 211, e.g. LEDs, connected in parallel via wires are provided in the ring-shaped housing 21, two power input terminals 212 are provided in front of the light sources 211 for being coupled with the printed circuit board 22, the printed circuit board 22 is also in a ring shape, two guiding wires 221 are extendedly provided on the front end of the printed circuit board 22 for being welded to the positive terminal and the negative terminal, in other words welded to an inner tube 32 and an outer tube 31 for lightening the lighting unit 2. The center of the lighting unit 2 is provided with a ring-shaped hole 23, at least one fan-shaped wing hole 231 is radially communicated with the ring-shaped hole 23, so when the cable 1 is provided in the ring-shaped hole 23, the wing hole 231 can be served to accommodate plastic materials for retaining the lighting unit 2 on the cable 1.

The conductive tube 3 is a conventional conductive socket and the conductive tube 3 has the above mentioned outer tube 31 and the above mentioned inner tube 32, an insulating material is provided between the outer tube 31 and the inner tube 32, and the bottom end of the conductive tube 3 is axially provided with an insulating tube 33. When being assembled, the two power wires 11, 12 are respectively connected to the rear ends of inner tube 32 and the outer tube 31 then a welding operation is processed so as to fasten the two power wires 11, 12 on the conductive tube 3; or the terminals 14 provided at the front ends of the power wires 11, 12 are respectively connected to the rear ends of the outer tube 32 and the inner tube 31, then a welding operation is processed in the welding holes 142 of the two terminals 14 so as to fasten the two terminals 14 on the conductive tube 3. A contacting end 143 of the terminal 14 of the signal wire 13 is provided inside the insulating tube 33, so the signal wire 13 is received and fastened at the rear center portion of the inner tube 32, the finished assembly is as shown in FIG. 6.

Figure 6:
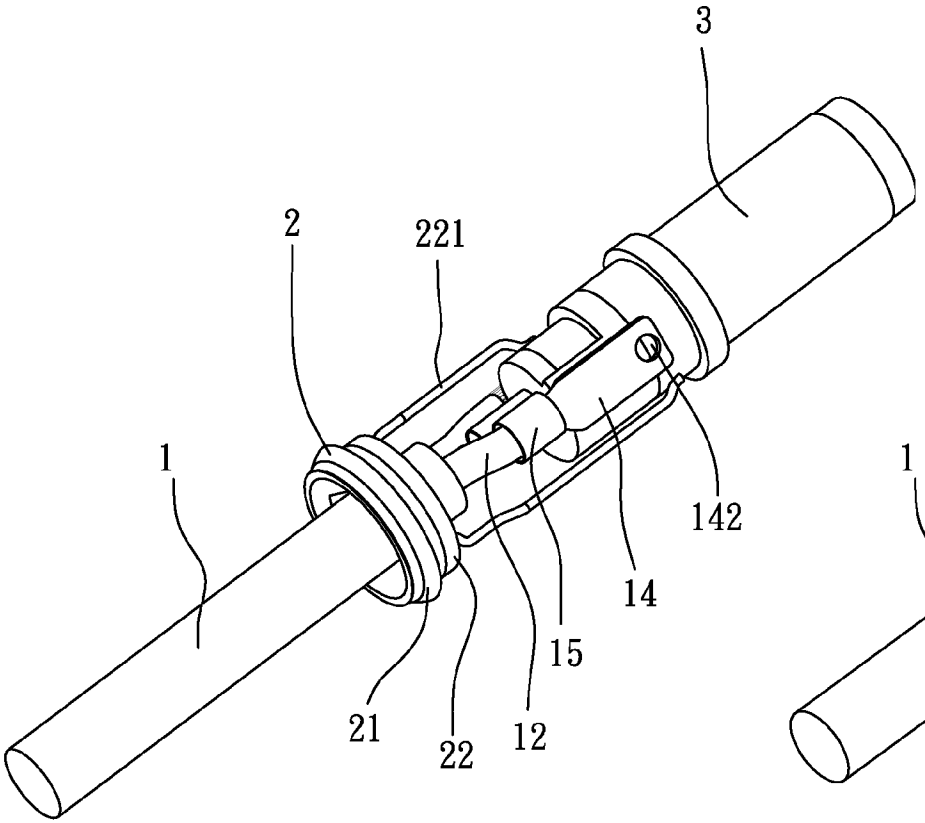
FIG. 6 is a 3D manufacturing flowchart for illustrating the manufacture of the power plug assembly provided by the present invention.
Figure 8:
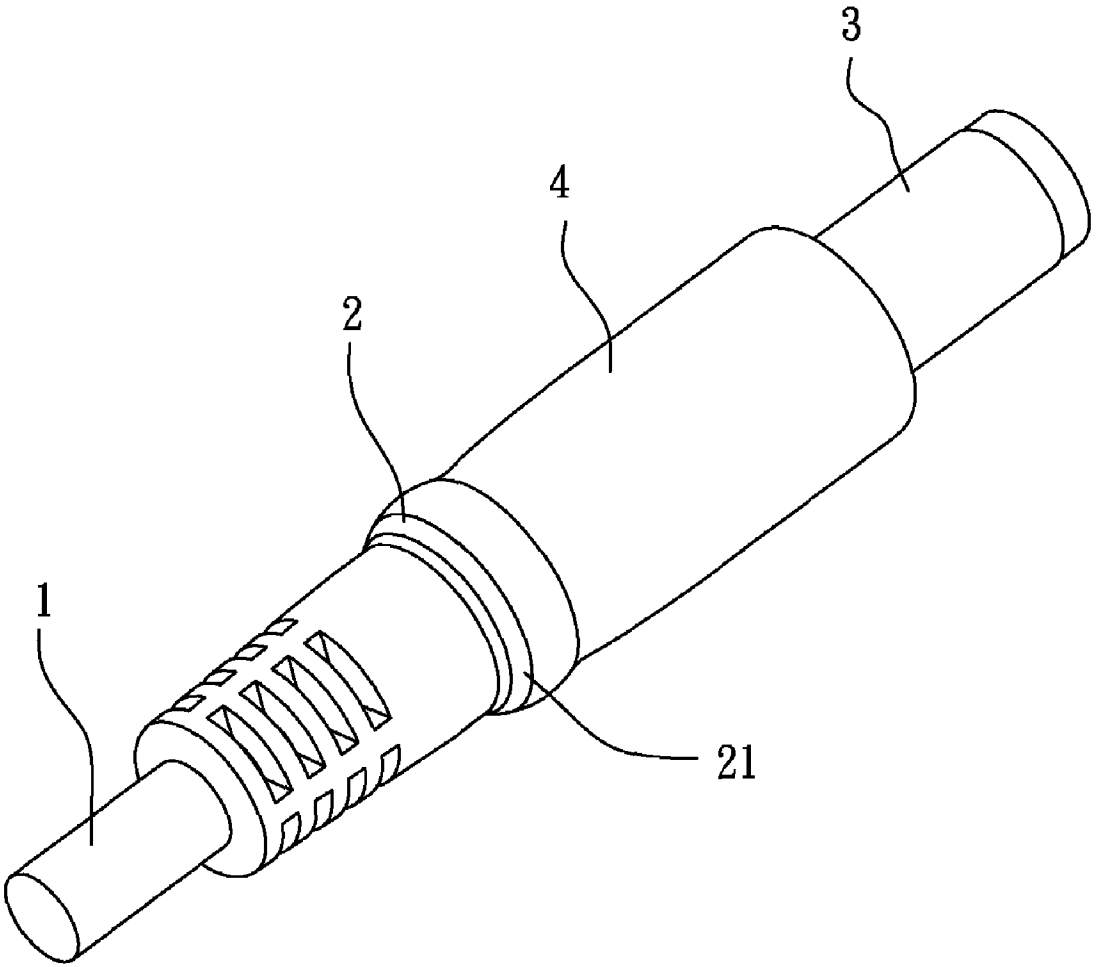
FIG. 8 is a 3D manufacturing flowchart for illustrating the manufacture of the power plug assembly provided by the present invention.
Figure 9:
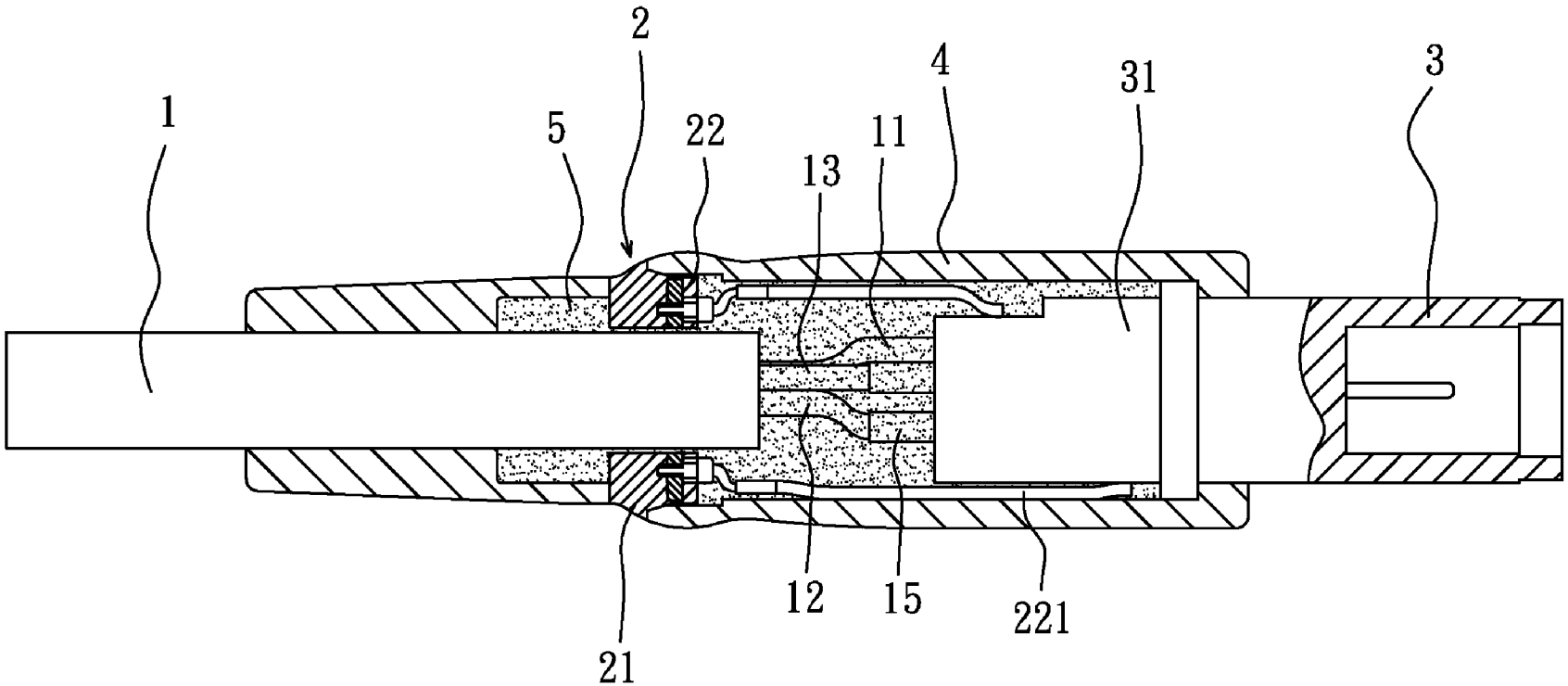
FIG. 9 is a cross section view of the power plug assembly provided by the present invention after being assembled.

The outer covering member 4 is an opaque member made by an embedded-type plastic injection, if the power plug assembly provided by the present invention is desired to be fabricated, the semi-finished product as shown in FIG. 6 is placed in a mold, then an operation of embedded-type plastic injection is processed, so the outer covering member 4 can be served to cover the rear portion of the conductive tube 3, the terminals 14, the front portion of the cable 1 and the lighting unit 2, and the plastic material is received in the wing hole 231 of the lighting unit 2 for enhancing the connecting strength between the lighting unit 2, the cable 1 and the outer covering member 4 and the ring-shaped housing 21 is exposed out of the outer covering member 4, thus a finished product as shown in FIG. 8 is obtained.

Figure 7:
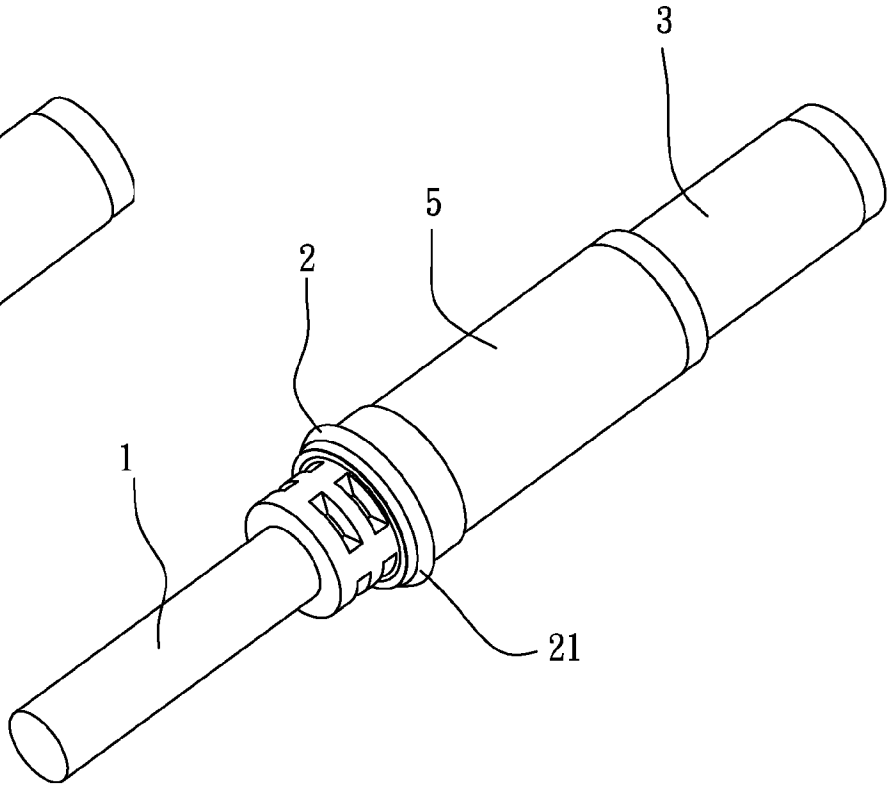
FIG. 7 is a 3D manufacturing flowchart for illustrating the manufacture of the power plug assembly provided by the present invention.

For further enhancing the connecting strength between the lighting unit 2 and the cable 1 of the semi-finished product as shown in FIG. 6, referring to FIG. 7, the semi-finished product shown in FIG. 6 is placed in a mold then a first operation of embedded-type plastic injection is processed, so an inner covering member 5 is served to cover the rear portion of the conductive tube 3, the terminals 14, the front portion of the cable 1 and the lighting unit 2, and the plastic material is received in the wing hole 231 of the lighting unit 2 for enhancing the connecting strength between the lighting unit 2, the cable 1 and the inner covering member 5 and the ring-shaped housing 21 is exposed out of the inner covering member 5.

As shown in FIG. 8, a second operation of embedded-type plastic injection is processed on the semi-finished product shown in FIG. 7, so an opaque outer covering member 4 is served to cover the inner covering member 5, and the ring-shaped housing 21 is exposed out of the outer covering member 4, thus a finished product as shown in FIG. 8 is obtained.

When the power plug assembly provided by the present invention is inserted to a power-receiving socket of an electronic product, e.g. a notebook computer, for establishing a circuit, the light sources 211 provided in the ring-shaped housing 21 of the lighting unit 2 are all lit, so the lights are illuminated to the outside via the transparent housing 21. Because the ring-shaped housing 21 is exposed out of the power plug assembly, the illuminating area is larger and the illuminations of the plural light sources 211 that are connected in parallel and provided in the ring-shaped housing 21 are increased, so a user can easily identify the status of the power supply by observing the lit light sources 211 provided inside the ring-shaped housing 21. The design of providing the lighting unit 2 having a function of illuminating indication to the power plug assembly provided by the present invention has broken through the conventional means of covering a conductive tube and a cable by an outer covering tube, thus the finished product has a better appearance.

By exposing the ring-shaped housing of the lighting unit out of the outer covering member, when the power plug assembly provided by the present invention is inserted to an electronic product, the circuit of the lighting unit is established and the light sources provided in the housing are lit, then the lights pass through the housing for obtaining a larger exposed illuminating area; the plural light sources connected in parallel are provided in the housing for obtaining a brighter illumination, so a user can more easily identify the status of the power supply; and by providing the lighting unit in the power plug assembly, the product has a better appearance.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power plug assembly comprising:

a cable having two power wires;

a lighting unit having a ring-shaped housing and a ring-shaped printed circuit board, each of the ring-shaped housing and the ring-shaped printed circuit board having a circular cross-section and a ring-shaped hole extending axially through a center thereof, the cable being inserted through the ring-shaped hole, and the lighting unit is positioned on the cable behind the two power wires, the ring-shaped printed circuit board is located in front of the ring-shaped housing, a plurality of light sources connected in parallel via wires are located in the ring-shaped housing and communicate with the ring-shaped hole, and the front end of the ring-shaped housing is provided with two power input terminals for being coupled with the ring-shaped printed circuit board, two guiding wires are extendedly provided on the front end of the ring-shaped printed circuit board;

a conductive tube having an outer tube and an inner tube, an insulating material is provided between the outer tube and the inner tube; with respect to the polarity, the two power wires and the two guiding wires are respectively provided on the outer tube and the inner tube, then a welding operation is processed so as to fasten the two power wires and the two guiding wires on the conductive tube; and an outer covering member made by an operation of plastic injection and served to cover the rear portion of the conductive tube, the front portion of the cable and the lighting unit, and the ring-shaped housing is exposed out of the outer covering member.

2. The power plug assembly as claimed in claim 1, wherein at least one wing hole is provided and is radially communicated with the ring-shaped hole, and the wing hole is served to accommodate the plastic material of the outer covering member.

3. The power plug assembly as claimed in claim 1, wherein the front end of each of the two power wires of the cable is respectively and optionally provided with a terminal, each rear end of the terminals is provided with a connecting section that is connected to the power wires, each of the terminals is provided with welding holes; after at least one of the terminals is provided on the outer tube or the inner tube with respect to the polarity, a welding operation is processed and the welding material pass through the welding holes for fastening the terminal on the conductive tube.

4. The power plug assembly as claimed in claim 1, wherein the cable is further provide with a signal wire, the front end of the signal wire is provided with a terminal, the rear end of the terminal is provided with a connecting section that is connected to the signal wire, a contacting end is extendedly provided at the front end of the terminal; the bottom end of the conductive tube is axially provided with an insulating tube for connecting the contacting end of the terminal, so the terminal is received and retained at the rear end of the conductive tube.

5. The power plug assembly as claimed in claim 3, wherein the connecting section provided at the rear end of each of the terminal is made by bending and pressing two sheet members that are oppositely provided.

6. The power plug assembly as claimed in claim 4, wherein the connecting section provided at the rear end of each of the terminal is made by bending and pressing two sheet members that are oppositely provided.

7. The power plug assembly as claimed in claim 5, wherein a thermal contracting tube is provided on the connecting section provided at the rear end of the terminal and the corresponding power wires or the signal wire, after the thermal contracting tube is heated then contracted, the connecting section is covered so as to form an insulation.

8. The power plug assembly as claimed in claim 6, wherein a thermal contracting tube is provided on the connecting section provided at the rear end of the terminal and the corresponding power wires or the signal wire, after the thermal contracting tube is heated then contracted, the connecting section is covered so as to form an insulation.

9. A power plug assembly comprising:

a cable having two power wires;

a lighting unit having a ring-shaped housing and a ring-shaped printed circuit board, each of the ring-shaped housing and the ring-shaped printed circuit board having a circular cross-section and a ring-shaped hole extending axially through a center thereof, the cable being inserted through the ring-shaped hole, and the lighting unit is positioned on the cable behind the two power wires, the ring-shaped printed circuit board is located in front of the ring-shaped housing, a plurality of light sources connected in parallel via wires are located in the ring-shaped housing and communicate with the ring-shaped hole, and the front end of the ring-shaped housing is provided with two power input terminals for being coupled with the ring-shaped printed circuit board, two guiding wires are extendedly provided on the front end of the ring-shaped printed circuit board;

a conductive tube having an outer tube and an inner tube; an insulating material is provided between the outer tube and the inner tube, according to the polarity, the two power wires and the two guiding wires are respectively provided on the outer tube and the inner tube, then a welding operation is processed so as to fasten the two power wires and the two guiding wires on the conductive tube;

an inner covering member made by an operation of plastic injection and served to cover the rear portion of the conductive tube, the front portion of the cable and the lighting unit, and the ring-shaped housing is exposed out of the inner covering member; and an outer covering member made by an operation of plastic injection and served to cover the inner covering member and the ring-shaped housing is exposed out of the outer covering member.

10. The power plug assembly as claimed in claim 9, wherein at least one wing hole is provided and is radially communicated with the ring-shaped hole, and the wing hole is served to accommodate the plastic material of the inner covering member.

11. The power plug assembly as claimed in claim 9, wherein the front end of each of the two power wires of the cable is respectively and optionally provided with a terminal, each rear end of the terminals is provided with a connecting section that is connected to the power wires, each of the terminals is provided with welding holes; after at least one of the terminals is provided on the outer tube or the inner tube with respect to the polarity, a welding operation is processed and the welding material pass through the welding holes for fastening the terminal on the conductive tube.

12. The power plug assembly as claimed in claim 9, wherein the cable is further provide with a signal wire, the front end of the signal wire is provided with a terminal, the rear end of the terminal is provided with a connecting section that is connected to the signal wire, a contacting end is extendedly provided at the front end of the terminal; the bottom end of the conductive tube is axially provided with an insulating tube for connecting the contacting end of the terminal, so the terminal is received and retained at the rear end of the conductive tube.

13. The power plug assembly as claimed in claim 11, wherein the connecting section provided at the rear end of each of the terminal is made by bending and pressing two sheet members that are oppositely provided.

14. The power plug assembly as claimed in claim 12, wherein the connecting section provided at the rear end of each of the terminal is made by bending and pressing two sheet members that are oppositely provided.

15. The power plug assembly as claimed in claim 13, wherein a thermal contracting tube is provided on the connecting section provided at the rear end of the terminal and the corresponding power wires or the signal wire, after the thermal contracting tube is heated then contracted, the connecting section is covered so as to form an insulation.

16. The power plug assembly as claimed in claim 14, wherein a thermal contracting tube is provided on the connecting section provided at the rear end of the terminal and the corresponding power wires or the signal wire, after the thermal contracting tube is heated then contracted, the connecting section is covered so as to form an insulation.

* * * * *